US007966920B2

(12) United States Patent
Martin

(10) Patent No.: US 7,966,920 B2
(45) Date of Patent: Jun. 28, 2011

(54) AIRBAG DEPLOYMENT AND DISPOSAL DEVICES AND METHODS

(75) Inventor: Charles Lee Martin, Danville, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 177 days.

(21) Appl. No.: 12/365,248

(22) Filed: Feb. 4, 2009

(65) Prior Publication Data

US 2010/0192757 A1 Aug. 5, 2010

(51) Int. Cl.
*F42B 33/04* (2006.01)

(52) U.S. Cl. ..... 86/50; 102/530; 102/531; 280/728.1; 280/741; 588/900; 588/403; 588/261

(58) Field of Classification Search ..... 86/50; 102/530, 102/531; 280/728.1, 741; 588/900, 403, 588/261

See application file for complete search history.

(56) References Cited

U.S. PATENT DOCUMENTS

| | | | | |
|---|---|---|---|---|
| 3,820,479 | A | 6/1974 | Fylling | |
| 4,325,309 | A * | 4/1982 | King et al. | 109/49.5 |
| 4,326,468 | A | 4/1982 | King et al. | |
| 4,893,569 | A | 1/1990 | Hansen | |
| 5,454,592 | A * | 10/1995 | Blumenthal et al. | 280/737 |
| 5,464,247 | A * | 11/1995 | Rizzi et al. | 280/737 |
| 5,468,012 | A * | 11/1995 | Mihm | 280/728.2 |
| 5,570,904 | A * | 11/1996 | Cuevas | 280/737 |
| 5,655,790 | A * | 8/1997 | Faigle et al. | 280/737 |
| 5,743,557 | A * | 4/1998 | Butt | 280/737 |
| 5,813,694 | A * | 9/1998 | Jeong | 280/737 |
| 6,709,012 | B1 * | 3/2004 | Tanaka et al. | 280/736 |
| 6,938,533 | B2 | 9/2005 | Holland et al. | |
| 2005/0210650 | A1 | 9/2005 | Lee | |
| 2006/0237955 | A1 | 10/2006 | Gorning | |

FOREIGN PATENT DOCUMENTS

| | | |
|---|---|---|
| DE | 10317063 | 11/2004 |
| JP | 200562994 | 9/2005 |

* cited by examiner

*Primary Examiner* — Bret Hayes
*Assistant Examiner* — Michael D David
(74) *Attorney, Agent, or Firm* — Dinsmore & Shohl LLP

(57) ABSTRACT

Disclosed is an airbag deployment device that includes a containment vessel and a retention rack disposed within the containment vessel, wherein the retention rack comprises at least one container, and wherein at least one airbag pyrotechnic actuator may be placed within the at least one container and secured through utilization of at least one pin.

20 Claims, 6 Drawing Sheets

AIRBAG DEPLOYMENT AND DISPOSAL DEVICES AND METHODS

TECHNICAL FIELD

The invention relates to devices and methods utilized in the deployment of airbag assemblies.

BACKGROUND

When an airbag assembly (also known as a "Supplemental Restraint System" or "SRS") is scrapped, the airbag is often first deployed by discharging a pyrotechnic actuator within the assembly. Due to worker safety concerns related to the discharging of the pyrotechnic actuator, airbag assemblies are traditionally transferred off-site for deployment and disposal. This off-site transfer leads to further concerns, such as the environmental impact and cost efficiency of the disposal process.

SUMMARY

One embodiment of an airbag deployment device includes a containment vessel and a retention rack disposed within the containment vessel, wherein the retention rack includes at least one container, and wherein at least one airbag pyrotechnic actuator may be placed within the at least one container and secured through utilization of at least one pin.

Another embodiment of an airbag deployment device includes a containment vessel, a retention rack disposed within the containment vessel, and at least one jig, wherein the retention rack includes at least one vertical container including a void and at least one aperture, and at least one horizontal container including a void and at least one aperture, and wherein the at least one jig cooperates with the at least one vertical container to secure at least one airbag pyrotechnic actuator within the void of the at least one vertical container.

One embodiment of a method of discharging an airbag pyrotechnic actuator includes providing an airbag deployment device including a containment vessel, a retention rack disposed within the containment vessel and at least one jig, wherein the retention rack includes at least one vertical container including a void and at least one aperture and wherein the at least one jig cooperates with the at least one vertical container to secure at least one airbag pyrotechnic actuator within the void of the at least one vertical container; securing the airbag pyrotechnic actuator to the at least one jig; securing the at least one jig within the void of the at least one vertical container of the retention rack; connecting an igniter of the airbag pyrotechnic actuator with a control panel of the airbag deployment device; and discharging the airbag pyrotechnic actuator through utilization of electricity controlled by a remote firing mechanism connected to the control panel of the airbag deployment device.

These and additional features can be more fully understood in view of the following detailed description, in conjunction with the drawings.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
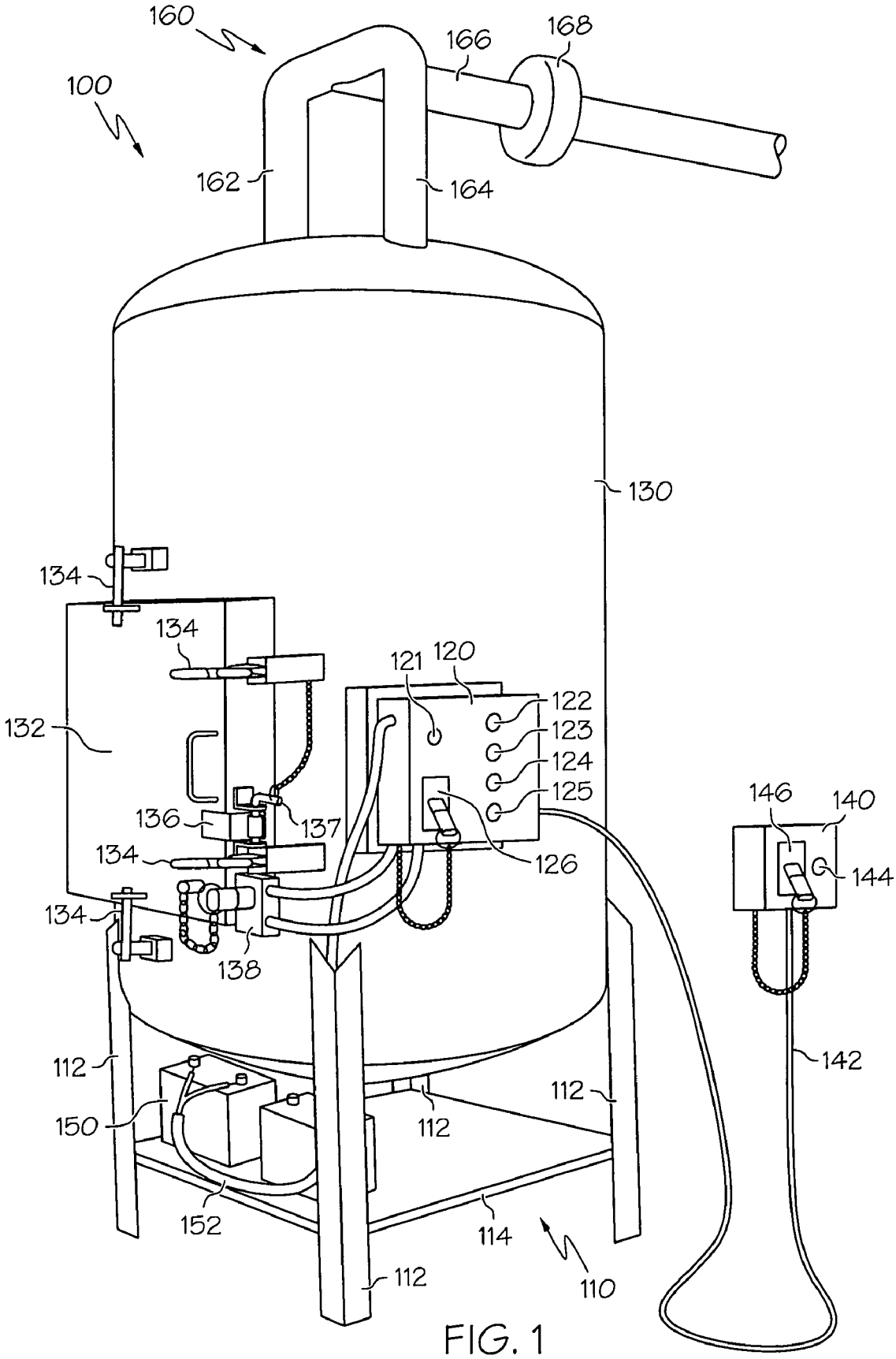
FIG. 1 is a perspective view of an exemplary airbag deployment device according to one embodiment of the present invention.

As will be discussed in relation to the figures, embodiments of an airbag deployment device 100 may include a base 110, a control panel 120, a containment vessel 130, a remote firing mechanism 140, a power source 150, an exhaust system 160 and a retention rack 170. It should be understood, however, that embodiments of device 100 may include additional structure, such as, for example, at least one jig 500,600 for cooperative use with retention rack 170.

Referring to FIGS. 1-4, a base 110 may be utilized in supporting device 100 on any surface. Base 110 may take any shape and/or size and may stabilize device 100 to a surface by any method known in the art. In the illustrated embodiment, base 110 includes a plurality of legs 112 and a center panel 114. Base 110 may be secured to device 100 through any method known in the art. Non-limiting examples of attachment methods include utilization of fasteners, welding, soldering, adhering, bonding and the like. Base 110 may be constructed of any material know in the art, including, but not limited to, steel, iron, aluminum, fiberglass, polymers, plastics and the like. In the illustrated embodiment, legs 112 are constructed of steel and welded to containment vessel 130 and center panel 114. Although the illustrated embodiment of device 100 includes four legs 112, other embodiments may include any number of legs. Center panel 114 may be utilized for stabilization of legs 114 and for support and storage of other elements of device 100, such as power supply 150. Base 110 may be further secured to the surface on which device 100 rests through any method known in the art, including the use of fasteners. Alternately, base 110 may merely rest on the surface on which device 100 rests, stabilized by the weight of the device. In addition, device 100 need not include base 110, as containment vessel 130 may be directly supported, stabilized and/or attached to a surface, or may be suspended from structure above the device.

Still referring to FIGS. 1-4, an at least partially hollow containment vessel 130 may be utilized to contain the expansion and explosion hazards created during the deployment of airbag assemblies and/or the discharging of airbag pyrotechnic actuators. The walls of containment vessel 130 may be of any thickness to contain the necessary pressure of a particular application of device 100. Containment vessel 130 may be constructed of any material know in the art, including, but not limited to, steel, iron, aluminum, fiberglass, polymers, plastics and the like. The illustrated embodiment of device 100 includes a steel containment vessel 130 that is capable of withstanding pressures of up to 150 psi. Of course, other pressures are contemplated. Containment vessel 130 may further be constructed in any dimensions depending on the particular application of device 100. The illustrated embodiment of device 100 includes containment vessel 130 that has a height of 72 inches and a width of 48 inches.

Figure 3:
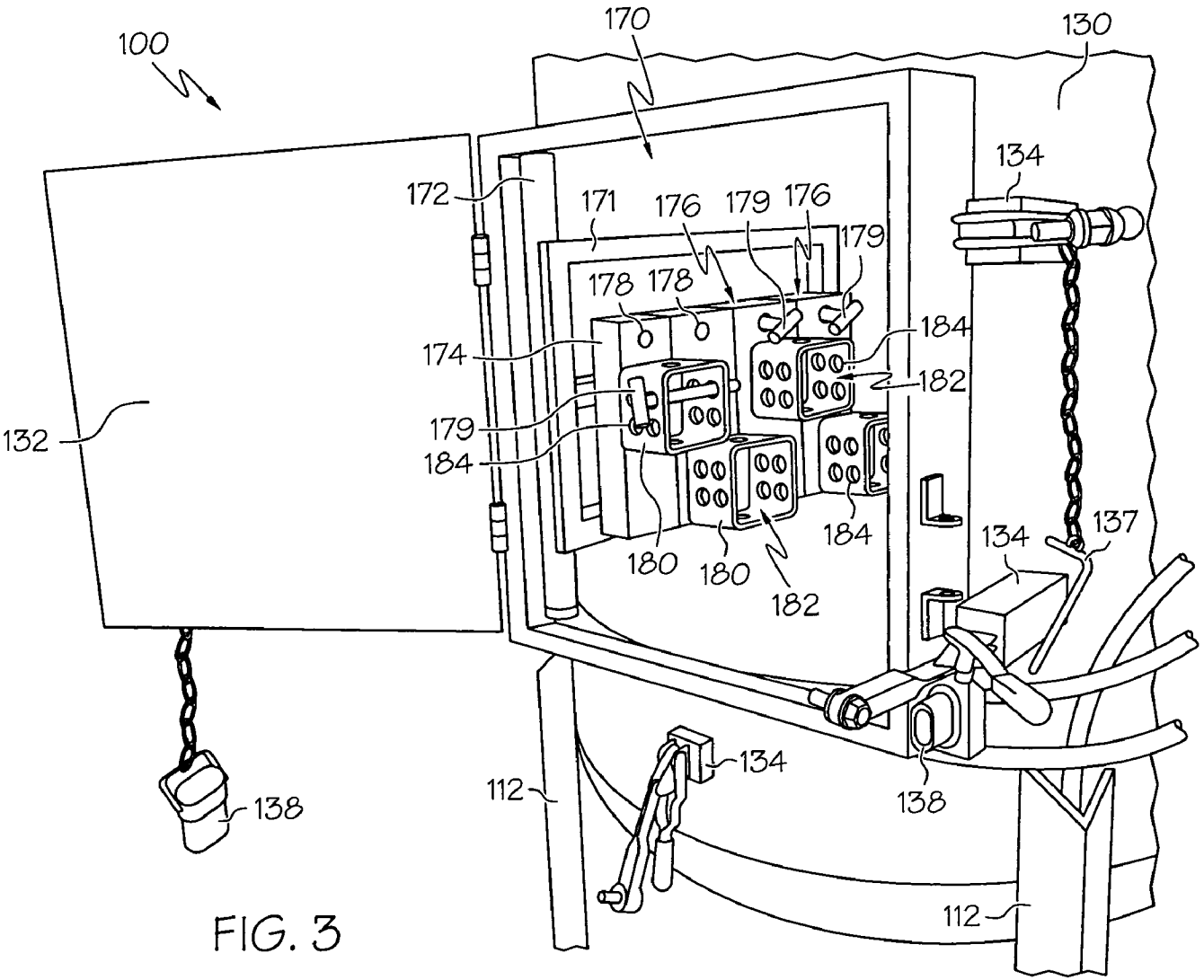
FIG. 3 is a perspective view of the exemplary device according to the embodiment of FIG. 1, with the door in an open orientation and the retention rack in a back position.
Figure 4:
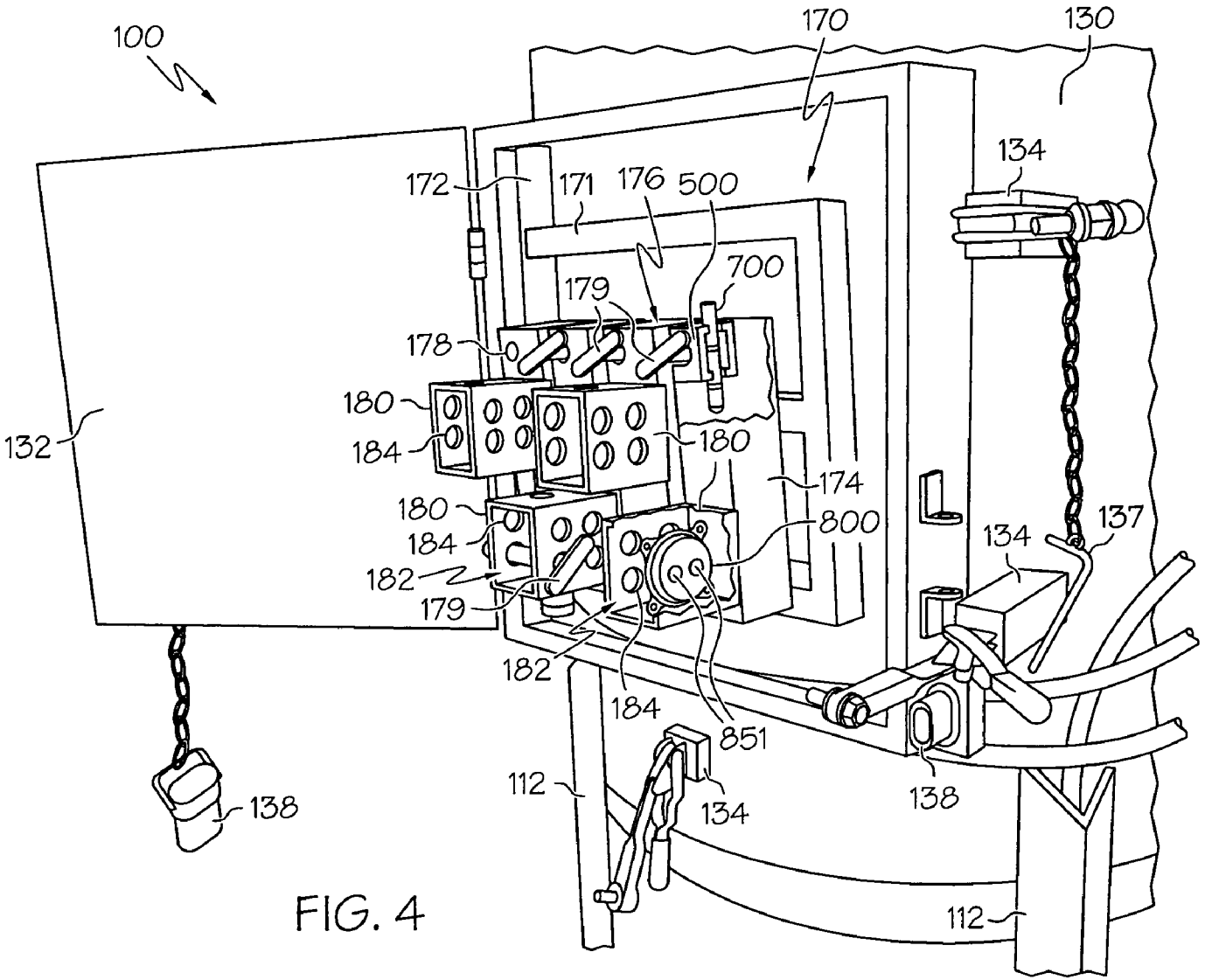
FIG. 4 is a perspective view of the exemplary device according to the embodiment of FIG. 1, with the door in an open orientation and the retention rack in a forward position.
Figure 6:
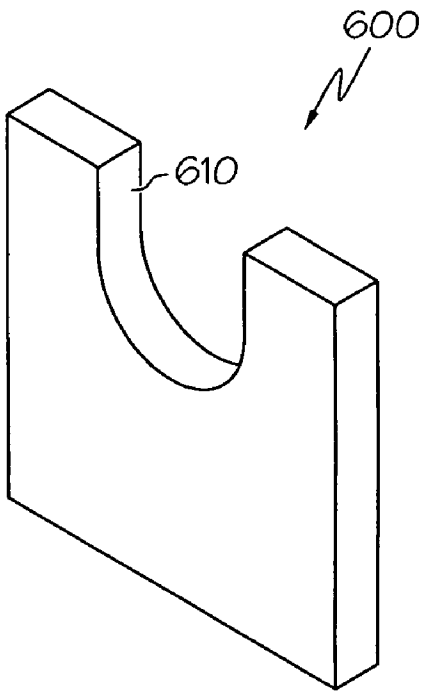
FIG. 6 is a perspective view of another exemplary jig for cooperative use with the retention rack of the exemplary device according to the embodiment of FIG. 1.
Figure 5:
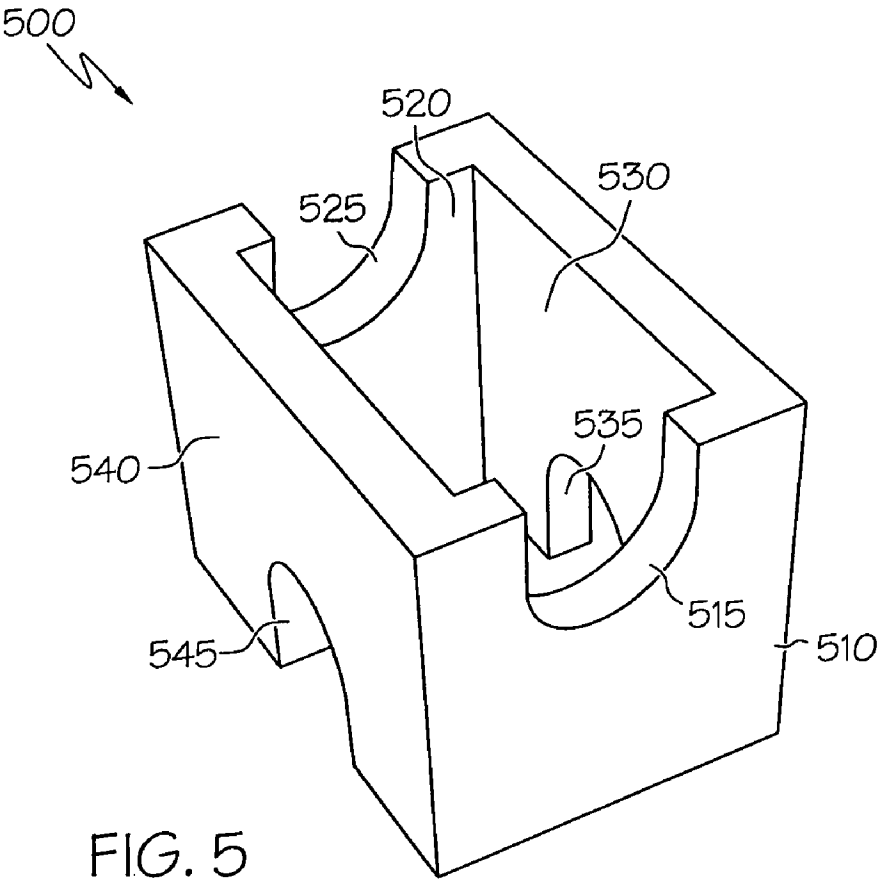
FIG. 5 is a perspective view of an exemplary jig for cooperative use with the retention rack of the exemplary device according to the embodiment of FIG. 1.

Containment vessel 130 may include door 132 for convenient access to the at least partially hollow interior of the containment vessel. As depicted in FIGS. 3 and 4, door 132 may be set on hinges to swing open and provide access to retention rack 170 (further described in detail below) for the placement and removal of airbag assemblies and/or airbag pyrotechnic actuators within containment vessel 130. However, door 132 need not be set on hinges, and in some embodiments, the entire door may be attached and removed from containment vessel 130 for access to the interior of the containment vessel. Door 132 may be constructed of any material know in the art, including, but not limited to, steel, iron, aluminum, fiberglass, polymers, plastics and the like. Door 132 may further be constructed in any dimensions depending on the particular application of device 100. The illustrated embodiment of device 100 includes door 132 that is constructed of steel and has a height of 24 inches and a width of 20 inches.

Figure 2:
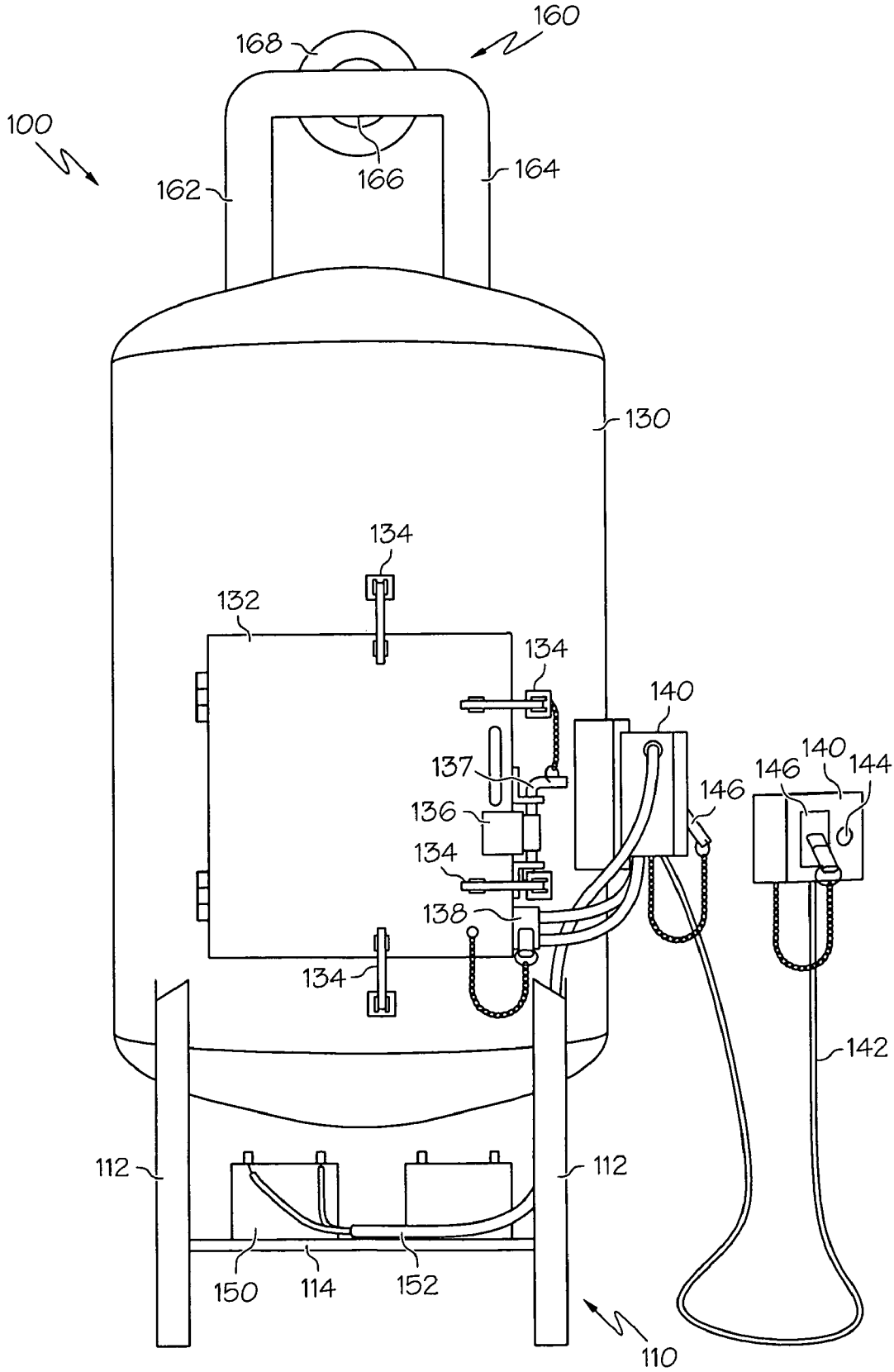
FIG. 2 is a front view of the exemplary device according to the embodiment of FIG. 1.

Door 132 may be capable of being positioned in an open orientation, as depicted in FIGS. 3 and 4, and a closed orientation, as depicted in FIGS. 1 and 2. Door 132 may be secured in the closed orientation through utilization of any locking device known in the art. As depicted in FIGS. 1 and 2, when door 132 is in a closed orientation, a clasp 136 on the door may cooperate with a pin 137 to ensure that the door remains in a closed orientation. Containment vessel 130 may further include one or more clamps 134 that further secure door 132 against the containment vessel in a closed orientation. As depicted in FIGS. 1 and 2, when door 132 is already in a closed orientation, clamps 134 may apply further pressure to the exterior of the door to ensure that door remains snug against containment vessel 130. The illustrated embodiment includes four mechanical clamps 134, but any number and/or type of clamps may be utilized.

In addition, containment vessel 130 may also include one or more safety interlocks 138 connected to control panel 120. Any safety interlock device(s) may be utilized, but the illustrated embodiment includes a plug and receptor safety interlock device 138 on containment vessel 130. As shown in FIGS. 1-4, the receptor is attached to containment vessel 130 and the plug is attached by a chain to door 132. Accordingly, for the plug to be capable of being secured to the receptor, door 132 must first be in a closed orientation. When the plug is secured into the receptor (as illustrated in FIGS. 1 and 2), safety interlock 138 is in a engaged arrangement, and when the plug is free from the receptor (as illustrated in FIGS. 3 and 4), safety interlock is in an unengaged arrangement. As described in detail below, for activation switch 144 of remote firing mechanism 140 to become operational, all safety interlocks of device 100, including safety interlock 138 of containment vessel 130, must be in engaged arrangements.

Referring again to FIG. 1, a control panel 120 may be disposed on containment vessel 130 to control power to device 100 and inform a user of the operational status of the device. The illustrated embodiment of device 100 includes control panel 120 that incorporates a power switch 121 and indicator lights 122,123,124,125, as well as a safety interlock 126. Any safety interlock 126 may be included on control panel 120, but the illustrated embodiment includes a plug and receptor device identical to safety interlock 138 of containment vessel 130. Power switch 121 may function to control power to device 100, and may comprise a selector switch that toggles between an "on" orientation and an "off" orientation. When power switch 121 of the illustrated embodiment is positioned in an "on" orientation, power is supplied to device 100 from power source 150 and indicator light 122 is illuminated. The illumination of the other indicator lights 123,124, 125 may be controlled by the particular arrangements of safety interlocks 126,138,146. In the illustrated embodiment, when safety interlock 138 is in an engaged arrangement, indicator light 123 is illuminated, when safety interlock 126 is in an engaged arrangement, indicator light 124 is illuminated, and when safety interlock 146 is in an engaged arrangement, indicator light 125 is illuminated.

Referring to FIGS. 1 and 2, a remote firing mechanism 140 may be connected to control panel 120. Remote firing mechanism 140 may be connected to control panel 120 through wire 142, or connection may be obtained wirelessly. Remote firing mechanism 140 may include an activation switch 144 and a safety interlock 146. Any safety interlock may be utilized on remote firing mechanism 140, but the illustrated embodiment includes a plug and receptor device identical to safety interlock 138 and safety interlock 126. Activation switch 144 of the illustrated embodiment comprises a push button switch, but the activation switch may comprise any type of switch known in the art. As previously mentioned, activation switch 144 of the illustrated embodiment is operational when all the safety interlocks 126,138,146 are in engaged arrangements, and non-operational if any one of the safety interlocks is in an unengaged arrangement. Further, device 100 need not include remote firing mechanism 140. In alternate embodiments of the device, activation switch 144 may be located on containment vessel 130 or control panel 120.

Device 100 may include any power source 150 known in the art. Non-limiting examples of power sources include any voltage and/or type of battery known in the art and an A/C wall outlet. In the illustrated embodiment, power source 150 comprises at least one 12V battery. The 12V battery may be connected to control panel 120 through utilization of wire 152. Power may then be relayed by another wire from control panel 120 to a terminal strip (not shown) within the interior of containment vessel 130. The terminal strip may then be electrically connected by another wire to an igniter of an airbag pyrotechnic actuator. Thus, control panel 120 may be electrically connected with the airbag pyrotechnic actuator. An electrical charge from power source 150 is used to deploy the airbag assembly and/or discharge the airbag pyrotechnic actuator.

Device 100 may also include an exhaust system 160 to vacate gasses from containment vessel 130 that are produced during the deployment of an airbag assembly and/or the discharging of an airbag pyrotechnic actuator. Any exhaust system may be utilized, but the illustrated embodiment includes exhaust system 160 that comprises a first exhaust pipe 162 and a second exhaust pipe 164 connected to apertures in the top of containment vessel 130. First exhaust pipe 162 and second exhaust pipe 164 join a third exhaust pipe 166 that travels to an open exterior space. In addition, an inline fan 168 may be disposed along exhaust system 160 to assist in vacating gasses to the open exterior space. However, in other embodiments, exhaust system 160 may be any structure that assists in vacating gasses to an open exterior space.

As illustrated in FIGS. 3 and 4, device 100 may include a retention rack 170 for the securing of airbag assemblies and/or airbag pyrotechnic actuators. Retention rack 170 may be constructed of any material know in the art, including, but not limited to, steel, iron, aluminum, fiberglass, polymers, plastics and the like. In the illustrated embodiment, retention rack 170 is constructed of welded steel. Retention rack 170 is located within the interior of containment vessel 130 and may include a frame 171 secured to a hinge 172. Hinge 172 allows retention rack 170 to rotate between a forward position, as depicted in FIG. 4, and a back position, as depicted in FIG. 3. Airbag assemblies and/or airbag pyrotechnic actuators may be loaded and unloaded from the device when retention rack 170 is in a forward position, and are positioned to be deployed and/or discharged when retention rack 170 is in a back position.

Retention rack 170 may further include at least one vertical container 174 and/or at least one horizontal container 180 attached to frame 171. In the illustrated embodiment, retention rack 170 includes four vertical containers 174 and four horizontal containers 180 attached to the front of the four vertical containers. Vertical containers 174 comprise sections of hollow, squared, 4 inch by 4 inch, steel tubing, approximately 18 inches in length. Accordingly, vertical containers 174 of the illustrated embodiment include a void 176 that runs the length of the vertical container. Vertical containers 174 may also include at least one aperture 178 for employment of a pin 179 and a removable strap (not shown) disposed along the open bottom of the container. As will be explained in further detail below, during discharge, vertical containers 174 may cooperate with various jigs to retain at least a portion of an airbag assembly and/or an airbag pyrotechnic actuator within void 176. In particular, jigs 500,600 (illustrated in FIGS. 4-8) cooperate with pin 179 and a removable strap and may be utilized to maintain side-curtain airbag pyrotechnic actuators within voids 176 of vertical containers 174.

In the illustrated embodiment, horizontal containers 180 are attached to the fronts of vertical containers 174, and comprise sections of hollow, squared, 4 inch by 4 inch, steel tubing, approximately 4 inches in length. Accordingly, horizontal containers 180 of the illustrated embodiment include void 182. Horizontal containers 180 may also include at least one aperture 184 for employment of a pin 179. As will be explained in further detail below, during discharge, horizontal containers 180 may also retain at least a portion of an airbag assembly and/or an airbag pyrotechnic actuator within void 182. In particular, pin(s) 179 and aperture(s) 184 may be utilized to maintain airbag pyrotechnic actuators contained in the steering wheel, the dashboard or otherwise within voids 182 of horizontal containers 180. In FIG. 4, part of one horizontal container 180 is cut-away to show an airbag pyrotechnic actuator from a steering wheel 800 sitting within void 182. Pin(s) 179 may then cooperate with apertures 184, to secure actuator 800 within void 182. Wires may then be utilized to connect the terminal strip inside containment vessel 130 to the igniter connectors 851 of the actuator in preparation for discharge.

Clips, fasteners and karabiners may also be utilized with apertures 178,184 in attaching seat belt tensioner pyrotechnic actuators at least partially within void 176,182 or exterior to vertical containers 174 and horizontal containers 180. Further, embodiments of retention rack 170 may also include a guide (not shown) for attachment of various airbag pyrotechnic actuators and/or various full airbag assemblies. The guide may model the structure that the airbag assembly is secured to within a fully built automobile, and may cooperate with a plurality of fasters and/or clips to secure the airbag pyrotechnic actuator/assembly to the guide.

Figure 7:
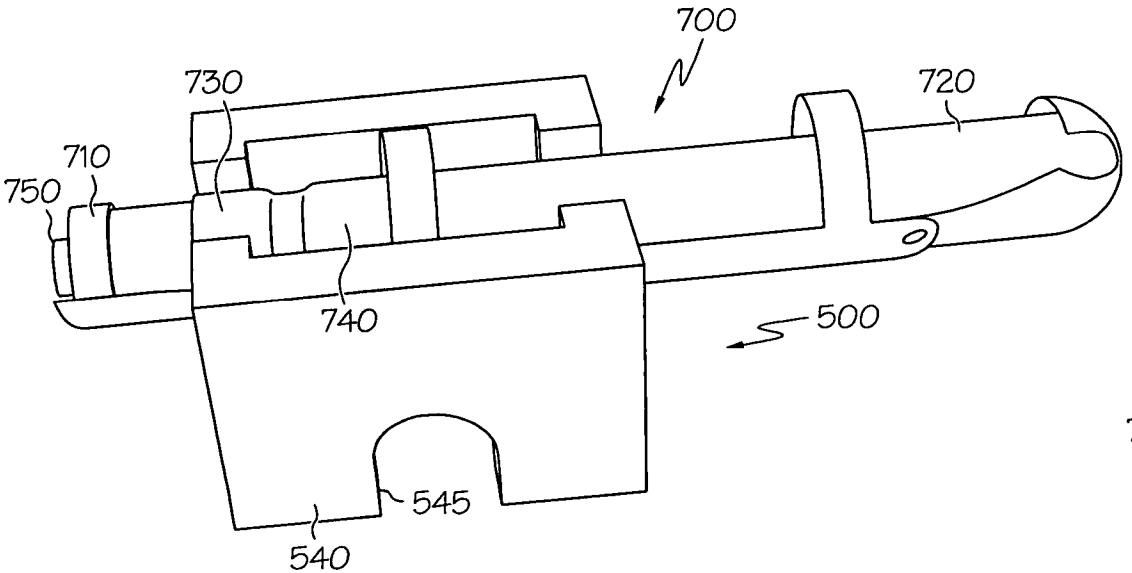
FIG. 7 is a perspective view of the exemplary jig of FIG. 5 with an engaged airbag actuator.

Referring to FIGS. 4-8, the device may further include jigs 500,600 for cooperation with vertical containers 174 of retention rack 170. In one embodiment, jig 500 comprises a steel block with a bottom 510, a top 520, a first side 530 and a second side 540. The dimensions of bottom 510 and top 520 of jig 500 are slightly smaller than the cross-sectional dimensions of void 176 that runs the length of the vertical container. Accordingly, jig 500 may fit within, and travel through, void 176. Jig 500 further includes four "U" shaped channels. A first actuator channel 515 is disposed on bottom 510, a second actuator channel 525 is disposed on top 520, a first pin channel 535 is disposed on first side 530 and second pin channel 545 is disposed on second side 540. As seen in FIG. 7, first and second actuator channels 515,525 may be utilized, for example, to secure a side-curtain airbag pyrotechnic actuator 700 to jig 500. When jig 500 is employed with retention rack 170, first and second pin channels 535,545, in cooperation with pin 179, may be utilized to hold jig 500 within void 176 of vertical container 174. Accordingly, as illustrated in FIG. 4, when jig 500 is positioned within void 176 in a manner such that pin channels 535,545 are aligned with aperture 178, pin 179 may be inserted through the aperture and the pin channels to secure jig 500 in that position within the void. When jig 500 is in such a position and secured by the insertion of pin 179 through both aperture 178 and pin channels 535,545, the jig is in a deployment orientation. In FIG. 4, a portion of one of the vertical containers 174 is cut-away to illustrate jig 500 in such a deployment orientation.

Figure 8:
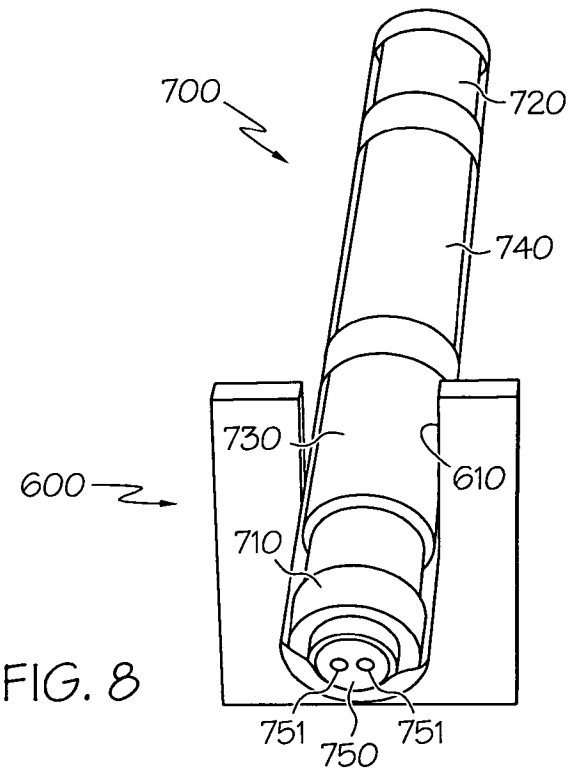
FIG. 8 is a perspective view of the exemplary jig of FIG. 6 with an engaged airbag actuator.

In another embodiment, jig 600 comprises a squared steel washer with a single "U" shaped channel 610. The dimensions of jig 600 are slightly smaller than the cross-sectional dimensions of void 176 that runs the length of the vertical container. Accordingly, jig 600 may fit within, and travel through, void 176. As seen in FIG. 8, channel 610 is utilized to secure a side-curtain airbag pyrotechnic actuator 700 to jig 600. When jig 600 is employed with retention rack 170, a strap may be placed across the bottom opening of vertical container 174. Once jig 600 is positioned within void 176 and below aperture 178, pin 179 may be inserted into aperture 178. Accordingly, jig 600 may be capable of movement within void 176, but is blocked from exiting vertical container 174 (by the strap at the bottom of the void and by the pin towards the top of the void). When jig 600 is in such a position and secured by the cooperation of a strap, pin 179 and aperture 178, the jig is in a deployment orientation.

Jigs 500,600 utilize the shape and size of actuator 700 to securely hold the actuator in the "U" shaped channel(s) of the jigs during discharge. Actuator 700 comprises a first end 710, a second end 720, a first body portion 730, a second body portion 740 and an igniter 750, wherein the first body portion is slightly narrower than the second body portion. To secure actuator 700 to jig 500, first body portion 730 is wedged into second actuator channel 525 (as seen in FIG. 7, a portion of the actuator towards second end may also be wedged into first actuator channel 515). To secure actuator 700 to jig 600, first body portion 730 is wedged into channel 610. During discharge, gas is quickly created and/or released from second end 720 of actuator 700. Such quick release of pressurized gas places a propelling force on actuator 700. However, because actuator 700 has second body portion 740 which is wider than first body portion 730, if the first body portion is forced free from second actuator channel 525 or channel 610 during discharge, the second body portion is blocked from traveling through second actuator channel 525 or channel 610. Accordingly, actuator 700 may be maintained within jig 500,600 throughout discharge.

The above detailed device may be utilized in a method of deploying an airbag assembly and/or discharging an airbag pyrotechnic actuator. To begin, a user may ensure that all safety interlocks 126,138,146 are in unengaged arrangements. Door 132 may be opened and retention rack 170 may be rotated to a forward position (depicted in FIG. 4). At this point, airbag assemblies and/or airbag pyrotechnic actuators may be secured to retention rack 170. In some applications, side-curtain airbag pyrotechnic actuators 700 may be secured to jigs 500,600 as described above, and the jigs then may be secured in deployment orientations within voids 176 of vertical containers 174 through utilization of pins 179 and/or straps. In other applications, airbag pyrotechnic actuators contained in the steering wheel, the dashboard or otherwise may be secured within voids 182 of horizontal containers 180 through utilization of pins 179. In yet other applications, seat belt tensioner pyrotechnic actuators may be secured at least partially within voids 176,182 or to the exterior of vertical container 174 or horizontal containers 180 through cooperation of clips, fasteners and karabiners with apertures 184. In still other embodiments, a guide may be employed for the attachment of various airbag pyrotechnic actuators and/or various complete airbag assemblies to retention rack 170.

Wires may now be utilized to connect the terminal strip located inside containment vessel 130 to the connection points 751,851 on the igniter of the airbag pyrotechnic actuators. The wires may include clips to connect the wires to connection points 751,851 on the igniter. As depicted in the side-curtain airbag pyrotechnic actuators of FIGS. 7 and 8, igniter 750 is located at first end 710 of the actuator and connection points 751 are located on the surface of the igniter. However, in other pyrotechnic actuators, the igniters and connection points may be positioned in various locations.

With airbag pyrotechnic actuators and/or various full airbag assemblies secured to retention rack 170 and wired to the terminal strip, the retention rack may be rotated into a back position (depicted in FIG. 3). Door 132 may be closed and locked by pin 137 being secured into clasp 136. To further secure door 132, clamps 134 may also be utilized. Once the door is closed and secured, power switch 121 on control panel 120 may then be utilized to provide power to device 100. When power switch 121 is set to the "on" position, indicator light 122 may be illuminated.

At this point, the user may place safety interlock 138 into a engaged arrangement, thus illuminating indicator light 123. A user may also place safety interlock 126 into a engaged arrangement, thus illuminating indicator light 124. Remote firing mechanism 140 may then be taken to a location remote from containment vessel 130. Once at the remote location, a user may place safety interlock 146 into a engaged arrangement, thus illuminating indicator light 125. With all indicator lights 122,123,124,125 illuminated, a user may depress an operational activation switch 144. Depressing activation switch 144 will supply electricity to the igniters of the airbag assemblies and/or airbag pyrotechnic actuators located within containment vessel 130. The electricity will deploy the airbag assemblies and/or discharge the airbag pyrotechnic actuators. The gasses released during deployment/discharge will be vacated from containment vessel through exhaust 160.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. An airbag deployment device comprising:

a containment vessel and a retention rack disposed within the containment vessel, the containment vessel containing a pressure from an expansion and explosion of at least one airbag pyrotechnic actuator discharged in the containment vessel;

wherein the retention rack comprises at least one container, and wherein the at least one airbag pyrotechnic actuator is placed at least partially within the at least one container and secured through utilization of at least one pin.

2. The device of claim 1, wherein the at least one container comprises at least one vertical container comprising a void and at least one aperture.

3. The device of claim 2, further comprising at least one jig that cooperates with the at least one vertical container to secure the at least one airbag pyrotechnic actuator at least partially within the void of the at least one vertical container.

4. The device of claim 3, wherein the at least one jig comprises first and second actuator channels configured to secure the at least one jig with the least one airbag pyrotechnic actuator.

5. The device of claim 4, wherein the at least one jig is capable of being secured in an deployment orientation with the retention rack, such that when the at least one jig is in the deployment orientation, the at least one jig is secured at least partially within the void of the at least one vertical container by insertion of the at least one pin though both the at least one aperture and at least one pin channel disposed on the at least one jig.

6. The device of claim 4, wherein the at least one airbag pyrotechnic actuator comprises a side-curtain airbag pyrotechnic actuator.

7. The device of claim 1, wherein the at least one container comprises at least one horizontal container comprising a void and at least one aperture.

8. The device of claim 7, wherein the airbag pyrotechnic actuator is retained at least partially within the void of the at least one horizontal container through insertion of the at least one pin through the at least one aperture.

9. The device of claim 8, wherein the at least one airbag pyrotechnic actuator comprises an airbag pyrotechnic actuator from a steering wheel or a dashboard of a fully built vehicle.

10. The device of claim 1, further comprising an exhaust system connected to the containment vessel, wherein the exhaust system exhausts gasses from the containment vessel that are produced during the discharge of the at least one airbag pyrotechnic actuator.

11. An airbag deployment device comprising:

a containment vessel, a retention rack disposed within the containment vessel, and at least one jig, the containment vessel containing a pressure from an expansion and explosion of at least one airbag pyrotechnic actuator discharged in the containment vessel;

wherein the retention rack comprises at least one vertical container comprising a void and at least one aperture, and at least one horizontal container comprising a void and at least one aperture;

wherein the at least one jig cooperates with the at least one vertical container to secure at the least one airbag pyrotechnic actuator at least partially within the void of the at least one vertical container; and wherein the at least one jig is capable of being secured in a deployment orientation with the retention rack, such that when the at least one jig is in the deployment orientation, the at least one jig is secured within the void of the at least one vertical container by insertion of at least one pin though both the at least one aperture of the vertical container and at least one pin channel disposed on the at least one jig.

12. The device of claim 11, wherein the at least one jig comprises first and second actuator channels configured to secure the at least one jig with the least one airbag pyrotechnic actuator.

13. The device of claim 12, wherein the at least one airbag pyrotechnic actuator comprises a side-curtain airbag pyrotechnic actuator.

14. The device of claim 11, wherein another airbag pyrotechnic actuator may be at least partially secured within the void of the at least one horizontal container by insertion of at least one pin through the at least one aperture of the horizontal container.

15. The device of claim 14, wherein the at least one airbag pyrotechnic actuator comprises an airbag pyrotechnic actuator that from a steering wheel or a dashboard of a fully built vehicle.

16. The device of claim 11, further comprising an exhaust system connected to the containment vessel, wherein the exhaust system exhausts gasses from the containment vessel that are produced during the discharge of the at least one airbag pyrotechnic actuator.

17. A method of discharging an airbag pyrotechnic actuator comprising:

providing an airbag deployment device comprising a containment vessel, the containment vessel containing a pressure from an expansion and explosion of at least one airbag pyrotechnic actuator discharged in the containment vessel, a retention rack disposed within the containment vessel, and at least one jig, wherein the retention rack comprises at least one vertical container comprising a void and at least one aperture and wherein the at least one jig cooperates with the at least one vertical container to secure the at least one airbag pyrotechnic actuator at least partially within the void of the at least one vertical container;

securing the airbag pyrotechnic actuator to the at least one jig;

securing the at least one jig within the void of the at least one vertical container of the retention rack;

connecting an igniter of the airbag pyrotechnic actuator with a control panel of the airbag deployment device; and discharging the airbag pyrotechnic actuator through utilization of electricity controlled by a remote firing mechanism connected to the control panel of the airbag deployment device.

18. The method of claim 17, wherein the at least one jig comprises first and second actuator channels configured to secure the at least one jig with the least one airbag pyrotechnic actuator.

19. The method of claim 18, wherein the at least one jig further comprises a first pin channel and a second pin channel and wherein the at least one jig may be placed in a deployment orientation, such that the at least one jig is in the deployment orientation when the at least one jig is positioned within the void of the vertical container such that the first pin channel and the second pin channel are aligned with the at least one aperture and a pin is inserted through the first pin channel, the second pin channel and the at least one aperture to secure the at least one jig within the void of the at least one vertical container.

20. The method of claim 17, further comprising at least one safety interlock disposed on the airbag deployment device, wherein the remote firing mechanism will only operate when all safety interlocks are in engaged arrangements.

* * * * *

UNITED STATES PATENT AND TRADEMARK OFFICE

CERTIFICATE OF CORRECTION

PATENT NO. : 7,966,920 B2
APPLICATION NO. : 12/365248
DATED : June 28, 2011
INVENTOR(S) : Charles Lee Martin It is certified that error appears in the above-identified patent and that said Letters Patent is hereby corrected as shown below:

Claim 11, column 9, line 1, change “though” with “through” --pin through both the at least--

Claim 15, column 9, line 18, remove “that” --tor from a steering wheel or a--

Signed and Sealed this
Sixteenth Day of August, 2011

David J. Kappos

David J. Kappos
*Director of the United States Patent and Trademark Office*